US008250997B2

(12) United States Patent
Stutznäcker

(10) Patent No.: US 8,250,997 B2
(45) Date of Patent: Aug. 28, 2012

(54) MULTIPLE NEEDLE SEWING MACHINE

(75) Inventor: Klaus Stutznäcker, Frenchen (DE)

(73) Assignee: Nähmaschinenfabrik Emil Stutznäcker GmbH & Co. KG (DE)

( * ) Notice: Subject to any disclaimer, the term of this patent is extended or adjusted under 35 U.S.C. 154(b) by 366 days.

(21) Appl. No.: 12/620,183

(22) Filed: Nov. 17, 2009

(65) Prior Publication Data

US 2010/0126396 A1 May 27, 2010

(30) Foreign Application Priority Data

Nov. 26, 2008 (EP) ..... 08020506

(51) Int. Cl.
*D05B 1/08* (2006.01)
*D05B 55/16* (2006.01)
*D05B 57/02* (2006.01)

(52) U.S. Cl. ..... 112/165; 112/166; 112/197

(58) Field of Classification Search ..... 112/87, 112/98–101, 163–166, 197, 199, 220, 221, 112/475.01, 475.17
See application file for complete search history.

(56) References Cited

U.S. PATENT DOCUMENTS

| | | | | |
|---|---|---|---|---|
| 922,243 | A | 5/1909 | Beard | |
| 3,077,846 | A | 2/1963 | Bono | |
| 3,348,506 | A | 10/1967 | Haberhauer | |
| 4,091,754 | A * | 5/1978 | Onembo | 112/200 |
| 4,386,572 | A * | 6/1983 | Slomma | 112/98 |
| 4,474,124 | A | 10/1984 | Yamazawa | |
| 4,546,712 | A * | 10/1985 | Willenbacher | 112/89 |
| 4,569,297 | A * | 2/1986 | Dusch | 112/221 |
| 4,815,404 | A | 3/1989 | Ellermann et al. | |
| 5,133,272 | A * | 7/1992 | Hayashi | 112/221 |
| 5,390,613 | A * | 2/1995 | Shibata | 112/80.43 |
| 5,404,823 | A * | 4/1995 | Abegglen et al. | 112/84 |
| 5,507,239 | A * | 4/1996 | Fujii et al. | 112/274 |
| 5,509,365 | A | 4/1996 | Cash | |
| 6,895,878 | B2 * | 5/2005 | Stutznacker | 112/117 |
| 2004/0000261 | A1 | 1/2004 | Stutznacker | |

FOREIGN PATENT DOCUMENTS

| | | |
|---|---|---|
| DE | 1 193 350 | 5/1965 |
| DE | 1 485 483 | 11/1970 |
| DE | 3324518 C1 | 10/1984 |
| EP | 0 081 289 A1 | 6/1983 |
| EP | 0 394 601 | 10/1990 |
| EP | 1 233 096 A2 | 8/2002 |
| GB | 2 270 702 A | 3/1994 |

* cited by examiner

*Primary Examiner* — Ismael Izaguirre
(74) *Attorney, Agent, or Firm* — Harness, Dickey & Pierce, P.L.C.

(57) ABSTRACT

A multiple needle sewing machine. The sewing machine includes a needle head, a first needle and a second needle both coupled to the head, a drive mechanism, a gripper shaft, and a first gripper hook and a second gripper hook both coupled to the gripper shaft. The drive mechanism is configured to translate the first needle together with the second needle, and to individually translate only one of the first needle or the second needle.

19 Claims, 5 Drawing Sheets

MULTIPLE NEEDLE SEWING MACHINE

CROSS-REFERENCE TO RELATED APPLICATION

This application claims priority to European Patent Application No. 08020506.5 filed Nov. 26, 2008, which is hereby incorporated by reference in its entirety.

The invention relates to a multiple needle sewing machine and in particular to a multiple needle chain stitch sewing machine, comprising stitch-forming sewing elements having at least two needles and at least one gripper shaft and a gripper hook arranged thereon, wherein a needle and a gripper hook respectively form a sewing element pair and wherein the needles and the gripper hooks are driven in a manner such as to perform chain stitches and in particular double chain stitches in a sewing material and preferably in a multilayer sewing material arranged on a sewing material support, using a needle thread and a gripper thread respectively. The invention also relates to a process for creating a sewing pattern in a sewing material and in particular in a multilayer sewing material, wherein at least one needle thread and at least one gripper thread are connected to form a chain stitch, in particular a double chain stitch, using a plurality of sewing bodies, namely at least one needle and gripper respectively.

From document EP 1 233 096 B1 a multiple needle chain stitch sewing machine with stitch-forming sewing elements is known that comprise at least one needle head and needles fixed to the needle head and at least one gripper shaft to which a gripper hook is fixed, wherein the needles and the gripper hook each form a sewing element pair and are driven in a such a manner that they perform chain stitches and in particular double chain stitches in a sewing material and preferably in a multilayer sewing material arranged on a sewing material support, using a needle thread and a gripper thread.

To be able to sew additional and/or supplementary patterns in an easy way in the sewing material using such a multiple needle sewing machine or to be able to adapt this multiple needle sewing machine in an easy manner for predetermined sewing jobs, adjustability of at least one and preferably of a plurality of needles between two positions is provided, wherein the needles in a first position participate in the sewing operation and in a second position during the sewing operation do not pierce the sewing material and that the needle or the needles adjustable between the two positions has or have associated a device for knotting the needle thread together with the gripper thread and/or a cutting device for the gripper thread and/or the needle thread. Such a multiple needle sewing machine has proven effective in prior art. Considering, however, that independently of the raised needles, all needles and also the needle head must be moved during each sewing operation, so that also the masses of the raised needles must be moved, and considering the requirement that the masses to be moved are as small as possible, there is a desire for a chain stitch sewing machine which is improved compared to this pre-known multiple needle chain stitch sewing machine.

Furthermore, from the introduction part of the above-mentioned document EP 0 394 601 A1 a device for locking and for releasing one or more embroidery needles in an embroidery machine or in a multiple needle embroidery machine is known, wherein the individual needles are also movable pneumatically between two positions, so that the needle in its one position does not participate in the embroidery and quilting operation. But it can be seen that this pre-known device includes the drawback that the entire mass of the quilting or embroidery needle must be moved even if this needle does not participate in the quilting or embroidery operation.

Furthermore, the document U.S. Pat. No. 5,509,365 discloses a multiple needle chain stitch sewing machine including two needle heads which are each subdivided into three sections, the sections each having several needles and both needle heads being driven through a common drive unit in the same or in opposite directions. The needle heads are alternately raised and lowered, so that the needles of the one needle head are immersed in the sewing material for stitch forming, while the needles of the second needle head are pulled out of the sewing material. But the needles of the two needle heads participate in the sewing operation. The movement of the two needle heads takes place in an alternating fashion and is synchronized with corresponding gripper rods below a sewing material support.

Based on the above-described prior art, it is an object of the invention to improve a multiple needle sewing machine and in particular a multiple needle chain stitch sewing machine in such a manner that the drawbacks of prior art are avoided and that especially the masses to be moved during the sewing operation are reduced. Furthermore, it is an object of the invention to improve a process of the kind as described in such a manner that the creation of a sewing pattern is made easier, especially by a reduction of the masses to be moved during the sewing operation.

The solution of this object provides that in a multiple needle sewing machine of the kind as described the needles are indirectly or directly connected to an oscillating driving shaft and that at least one and preferably more needles can be stopped and particularly decoupled from the oscillating driving shaft in such a manner that the needle(s) in a position stopped or decoupled from the oscillating driving shaft is(are) not translated in the direction of the sewing material support and thus does(do) not pierce the sewing material.

On part of the process of the invention, the solution of the object provides that after the completion of a stitch, preferably after completion of an element of the sewing pattern, at least one needle is moved from a position in which it is coupled to the oscillating driving shaft to a position in which it is decoupled from the oscillating driving shaft, so that the needle that is decoupled from the oscillating driving shaft does not participate in at least the next stitch and preferably in next following element of the sewing pattern.

Accordingly, in a multiple needle sewing machine of the invention it is provided that the individual needles are connected to the oscillating driving shaft, wherein the individual needles can be decoupled from the drive. As a result, in a multiple needle sewing machine according to the invention it is no longer required to move all the needles up and down in an oscillating fashion together with the needle head. The needles are driven directly. Driving takes place for example via the driven, oscillating driving shaft and crank mechanisms that transform the rotary movement of the driving shaft driven in an oscillating fashion into a translational movement of the needles.

A further feature of the invention provides that the oscillating driving shaft is connected to the needle through a driving lever designed as a cam and having a seat, and through a connecting rod that can be coupled to and decoupled from the seat. Here it is provided that the seat is located on the cam and that on the needle or on a needle holder the connecting cam is formed with a matching piece that can be locked in the seat. Of course, a kinematic inversion is possible in the sense that the seat is provided on the connecting rod and the matching piece is arranged on the cam. The connecting rod is arranged for at least a limited pivoting movement about the needle, so that the connecting rod in a raised position of the needle can be decoupled from the seat or coupled to the seat.

In the coupled position, the connecting rod extends in the direction of the longitudinal axis of the needle, in order to guarantee that the forces are transmitted to the needle as fully as possible.

Furthermore, in a multiple needle sewing machine according to the invention it is provided that the needle(s) can be hydraulically or pneumatically coupled to the oscillating driving shaft and/or decoupled from the oscillating driving shaft. Accordingly, through the coupling or decoupling of the needles it becomes possible to use double acting hydraulic or pneumatic cylinders that can be controlled independently from each other. Preferably, the pneumatic or hydraulic cylinders engage on the above-described connecting rod, whereby the connecting rod can be displaced towards the oscillating driving shaft and especially the seat by means of the pneumatic and/or hydraulic cylinder and can be pulled out of this seat.

A further feature of the invention provides that each needle is arranged for replacement in a mounting support, the mounting support being arranged between the oscillating driving shaft and the needle. This construction has the advantage that in the case of a needle breakage it is sufficient to merely replace the needle, the rest of the drive remaining unchanged, so that subsequent adjustment steps are not necessary.

In one embodiment of the multiple needle sewing machine according to the invention needles with mounting supports are provided, wherein a needle is inserted in an axially aligned bore of the mounting support and fixed by means of a screw, particularly a grub screw. The mounting support has a laterally arranged projection that is fixed in a corresponding seat on a carrier movable in a translational fashion. Constructed like this, the mounting support of the needle is movable via motional mimics in such a way that the projection is inserted in the corresponding seat and locked if necessary. Locking can take place purely mechanically or electromagnetically.

According to a further feature, an alternative to the pneumatic or hydraulic coupling and/or decoupling of the needles to or from the oscillating driving shaft is given in that the needle(s) can be coupled to and/or decoupled from the drive electromechanically and especially via a toothed rod and a pinion driven by an electric motor and meshing with the toothed rod.

A further feature of the invention provides that the gripper hooks can be decoupled from the gripper shaft. In this respect is turned out to be an advantage if that gripper is decoupled from the gripper shaft which cooperates with a correspondingly decoupled needle. Of course, it always is also possible for the gripper hooks being driven even if individual needles are not driven. But in this case additional needle thread is consumed and the problem may arise that excessive gripper thread wraps around the gripper hook and/or the gripper shaft and affects the operation of the chain stitch sewing machine.

Accordingly, a further feature provides that advantageously the gripper hook and the associated needles can be decoupled.

Concerning the process of the invention, it turned out to be an advantageous further development that the needle thread is knotted together with the gripper thread at the end of the finished sewing pattern element or at least after the completion of the last sewing pattern element, but in any case after a last stitch before the beginning of the next sewing pattern element. Alternatively, it can be provided that the needle and/or gripper thread is or are cut especially before the beginning of the next sewing pattern element. Cutting, especially cutting of the gripper thread, takes place at a length that prevents the gripper thread from being pulled out of the bores arranged in the gripper hook. At the same time, on the sewing material side, a length of the gripper thread must be provided that prevents the chain stitch from opening automatically.

A further development of the process of the invention provides that preferably before the beginning of the next sewing pattern element the sewing material is moved in the sewing direction, in order to withdraw the needle thread for its extension from the thread supply, before the needle thread is knotted together with the gripper thread and/or cut. By proceeding in this way, the above-mentioned requirements are met.

Moreover, an advantageous further development of the process of the invention provides that several needles arranged on at least one needle head are coupled or decoupled simultaneously. This construction allows different sewing patterns to be sewn in an easy way. The needles are preferably hydraulically, pneumatically or electromechanically coupled or decoupled.

Further, the invention provides that the needles are coupled or decoupled via a programmable control. Finally, a further development of the invention provides that the programmable control takes place in line with one or more sewing patterns.

Further features and advantages of the multiple needle sewing machine according to the invention or of the process according to the invention will become apparent from the following description of the attached drawings.

BRIEF DESCRIPTION OF THE DRAWINGS

In the drawings it is shown by:

In FIG. 1 a machine frame is shown in cross section. The machine frame is formed by two U-shaped elements that are aligned to each other with their legs, so that a box-like machine frame is formed. Above the machine frame driving shafts extend parallel to the longitudinal direction of the needle head 1, the driving shafts being fixed for rotation with cams, said cams and the driving shafts forming a drive for the needles. The driving shafts of the drive move in an oscillating fashion, said oscillating movement of the driving shafts being transformed into a translational movement of the needles.

Figure 1:
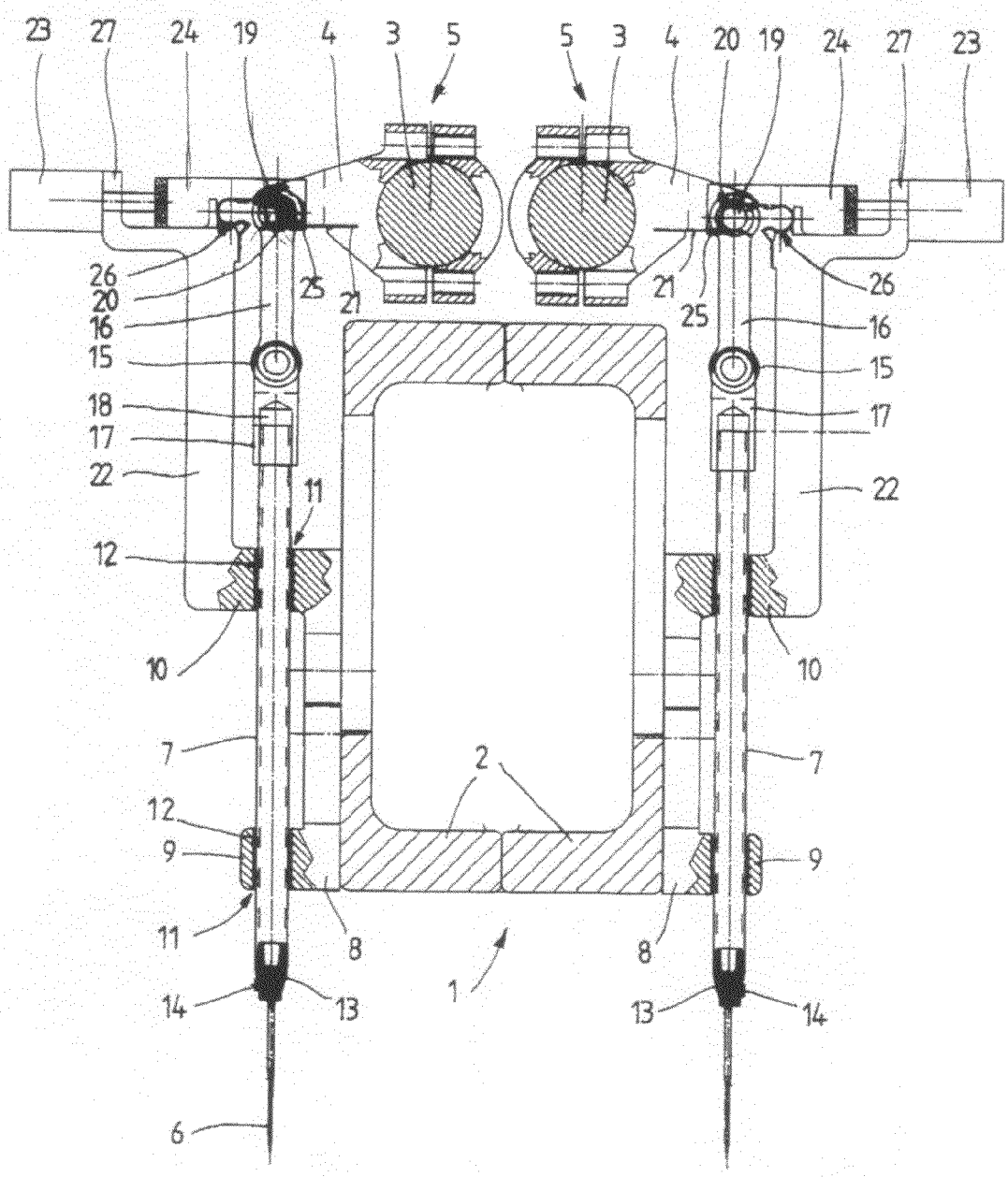
FIG. 1 a machine frame with two driven needles in cross section.

The needles are arranged in mounting supports capable of performing a translational movement via the drive. The mounting supports are guided on guide elements fixed on both sides of the machine frame, each guide element having two legs, with a respective bore. The bores are coaxially aligned, with a slide bearing fixed in the bores. Each mounting support includes on an end facing the needle a bore in which a pluggable member is fitted, said pluggable member being held in a positive and/or non-positive fashion in the bore. Each pluggable member has a locating bore for the needle and a bore that extends transversely to the locating bore, a grub screw being screwed in this bore for frictional connection with the needle.

On the end opposite the bore for seating the pluggable member, the mounting support includes a joint by which two members are articulated to each other, the first member including a seat for the mounting support and the second member being constructed as a connecting rod 16. Preferably, the mounting support 7 is screwed to the seat, an external thread being suitable for example in the region of the mounting support 7 and an internal thread being suitable in the region of the seat.

The connecting rod includes on its free end a cylinder extending with its longitudinal axis at right angles to the longitudinal axis of the connecting rod. Through this cylinder the connecting rod is connected to the drive, namely the cam.

To this end, the cam includes on its end facing away from the driving shaft a semi-circular seat, the diameter of which substantially corresponds to the diameter of the cylinder. Below the seat, a spring element is arranged on the cam, so that the cylinder is clamped between the seat and the spring element. On its free end, the spring element is bent away from the seat.

The oscillating movement of the driving shaft is transmitted as a translational movement through the cam to the connecting rod and thus to the mounting support and the needle, so that the mounting support and the needle perform an up and down movement guided in the bores of the guide element when the cam is connected to the connecting rod.

The leg of the guide element includes a support oriented at right angles to the leg 10 and designed substantially in an L-shape, the support carrying on the free end thereof a liner motor, for instance in the form of a pneumatic cylinder, by which a sliding element can be moved. The sliding element has a movement direction at right angles to the longitudinal axis of the mounting support, and the sliding element includes a projection overlapping the cylinder.

Furthermore, on the support an undercut seat from spring steel is arranged. The seat is substantially designed in the form of a section of an arc of a circle, the diameter of the seat substantially corresponding to the diameter of the cylinder.

By the sliding element the connecting rod is moved between a position coupled to the cam above the spring element and a position in which the cylinder is received in the seat and is consequently not coupled to the cam and hence to the oscillating driving shaft. The movement of the sliding element is performed via a linear motor. For limiting the distance of movement, a stopper is additionally provided on the free end of the support.

In the above-described embodiment each needle of each needle row includes an oscillating drive with a cam and a connecting rod as well as the associated movement device. All cams are fixed for rotation with the driving shaft. It is also possible to arrange a clutch between each cam and the driving shaft enabling individual cams and thus individual needles being coupled to or decoupled from the driving shaft. Accordingly, these constructions allow each individual needle or several needles to be decoupled from the oscillating driving shaft, so that during the creation of a sewing pattern in a sewing material (not further shown) the number and the arrangement of the needles creating the sewing pattern can be individually controlled. An important advantage of this construction is that non-driven needles are not moved during the sewing operation, so that merely the masses of the driven needles must be considered. Moreover, this construction allows the machine frame to be disengaged, since driving of the needles takes place directly and not indirectly via the machine frame.

Figure 2:
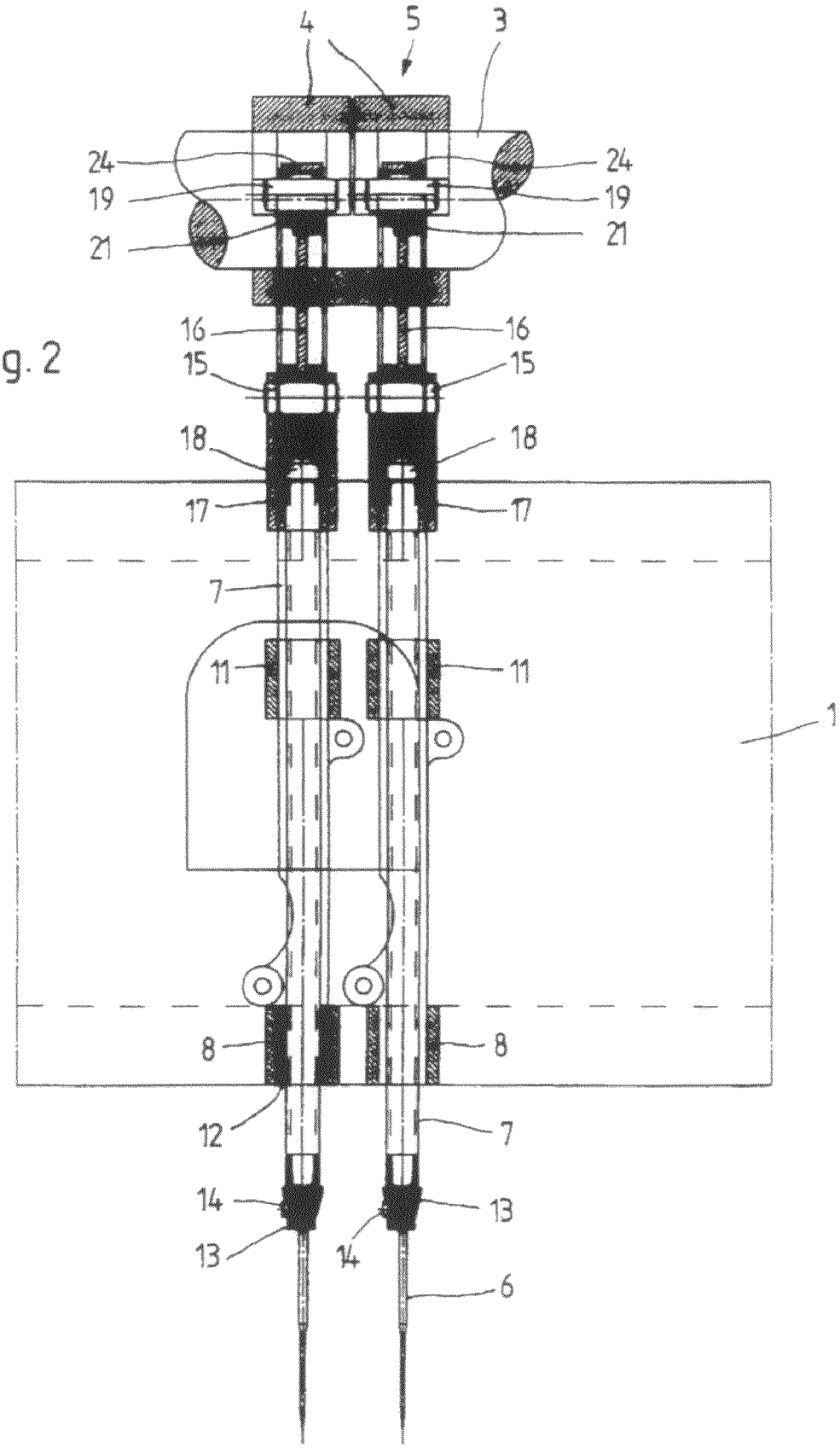
FIG. 2 a part of the machine frame according to FIG. 1 in a longitudinal view.
Figure 3:
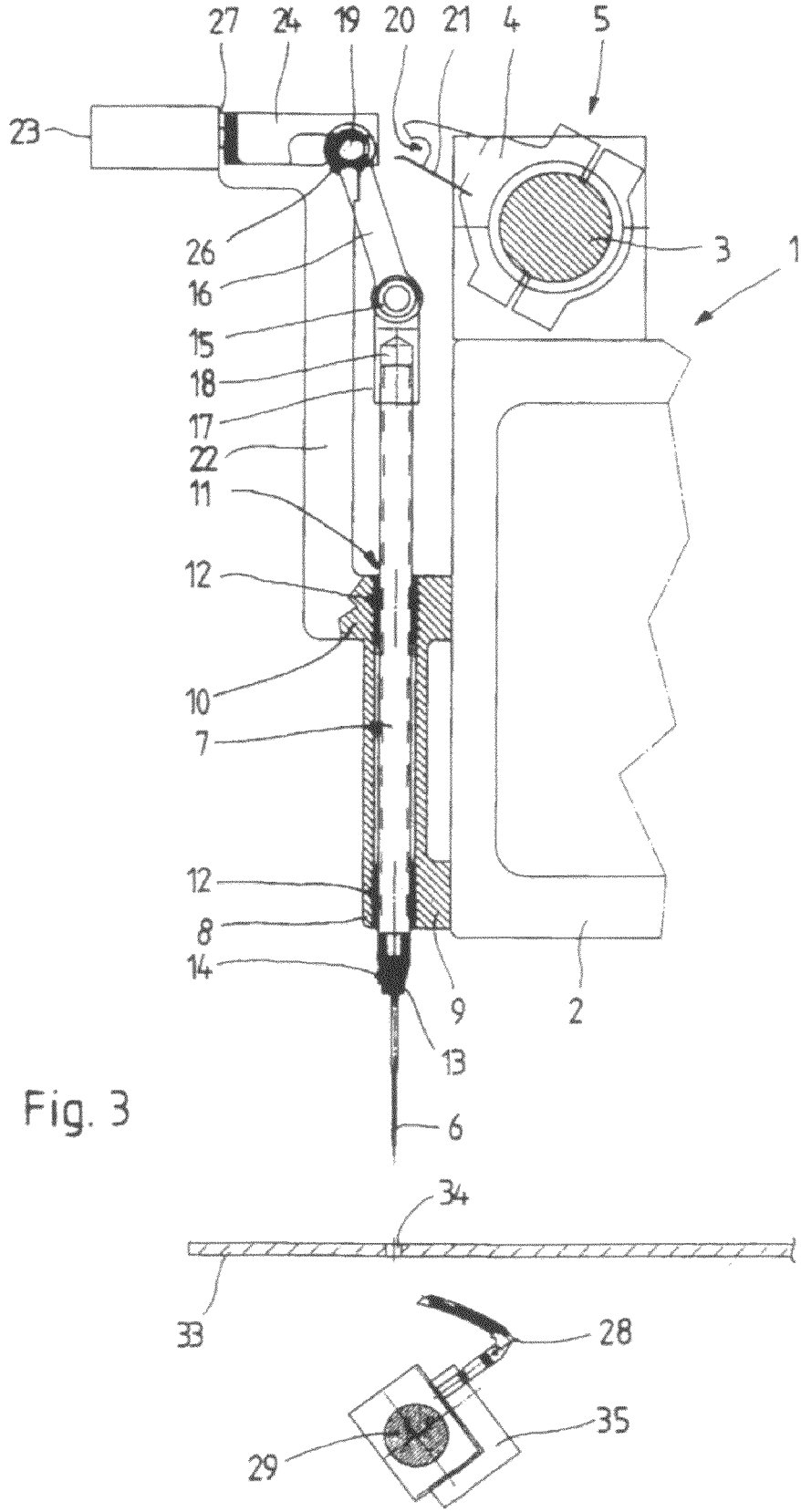
FIG. 3 one of the needles according to the FIGS. 1 and 2 in a decoupled position.
Figure 4:
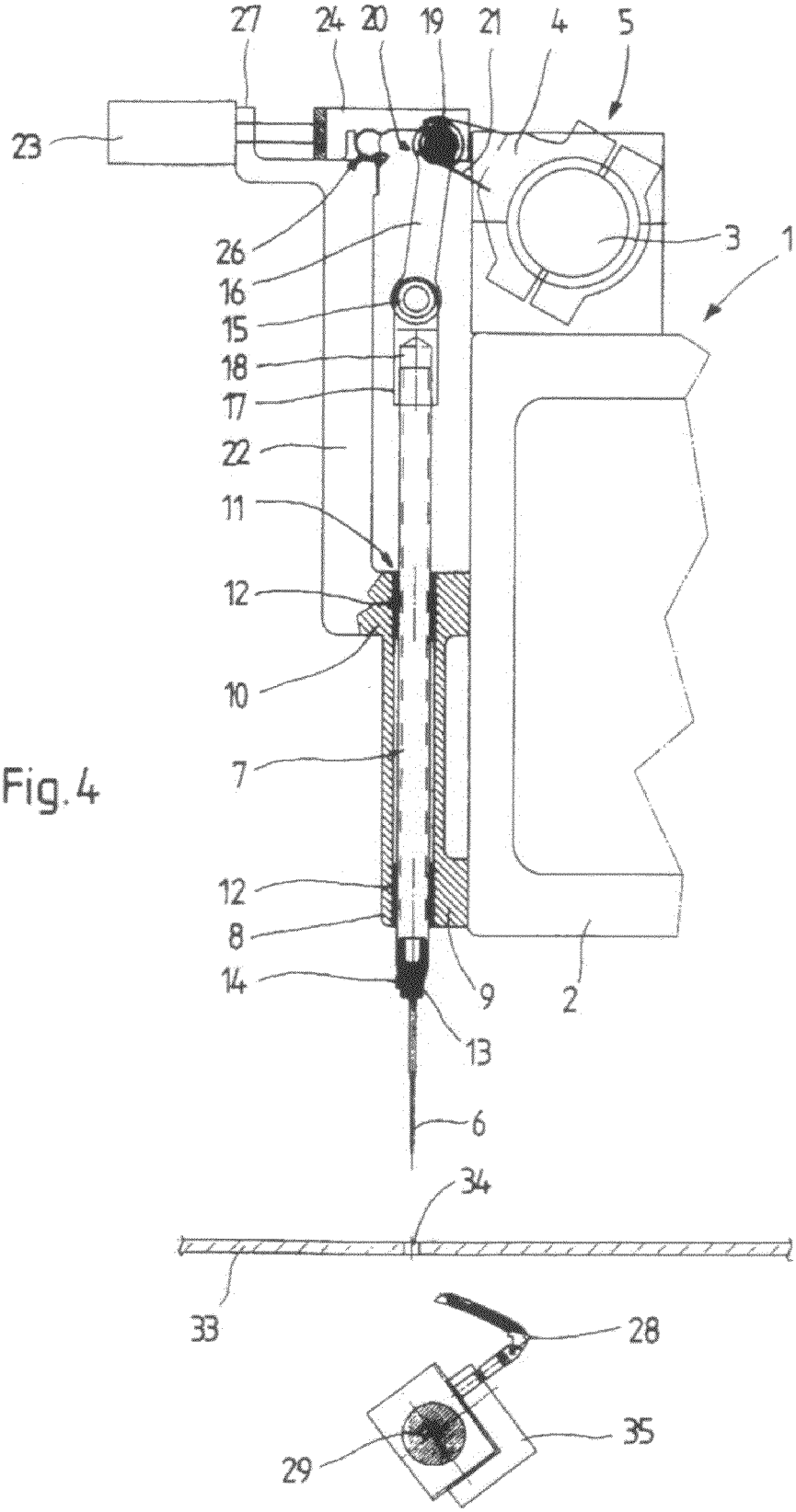
FIG. 4 the needle according to FIG. 3 in a coupled and raised position.
Figure 5:
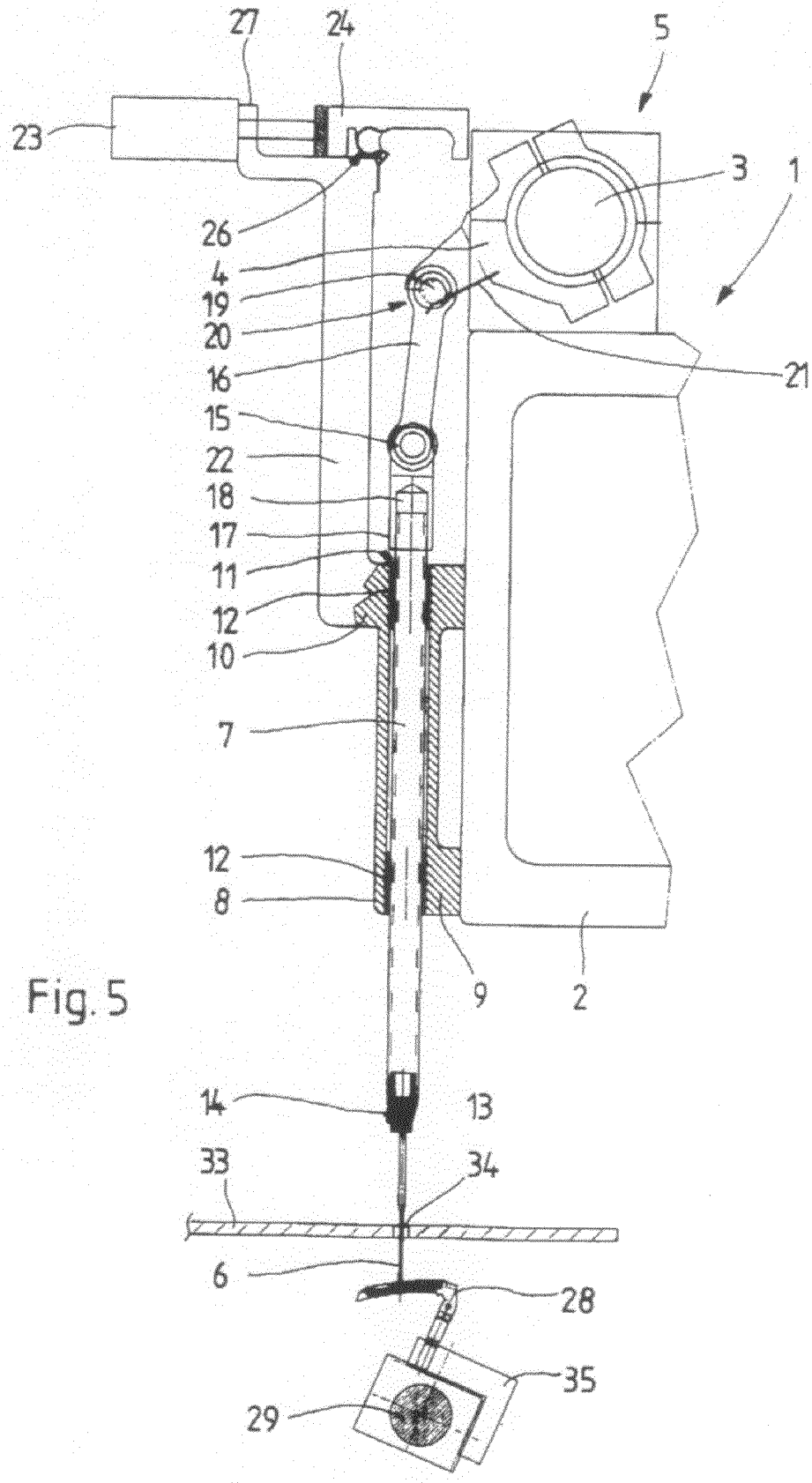
FIG. 5 the needles according to the FIGS. 3 and 4 in a coupled and lowered position.

The FIGS. 3 to 5 illustrate a part of the device shown in the FIGS. 1 and 2 in three operating positions. FIG. 3 shows the decoupled position, in which the cylinder is unlocked from the seat, so that the cam performs oscillating movements through the drive of the driving shaft 3, without the needle 6 being translated in the direction of a sewing material support 33. FIG. 3 additionally shows a position of the cam 4, in which coupling or decoupling of the cylinder to or from the seat 20 is possible. In the decoupled position according to FIG. 3 the sliding element 24 is displaced in the direction of the linear motor 23, so that the sliding element 24 rests against the stopper 27.

FIG. 4 shows a position of the cam 4 corresponding to the position shown in FIG. 3, with the sliding element 4 being extended from the linear motor 23. By the translational movement of the sliding element 24 the element 16 is pivoted about the connecting rod 15 in the direction of the seat 20 and locked there by the spring element 21. Thus the element 16 is coupled via the cylinder 19 to the seat 20 of the cam 4, so that in the following the needle 6 is driven to oscillate via the driving shaft 3 and the cam 4 in such a manner that the needle 6 is translated in the direction of the sewing material support 33. A corresponding position of the needle 6, in which the needle 6 penetrates through a bore 34 in the sewing material support, is illustrated in FIG. 5.

The FIGS. 3 to 5 additionally show a gripper shaft 29 and a gripper hook 28, which is arranged for replacement in a mounting support 35 that is fixed for rotation with the gripper shaft 29. The gripper hook 28 has in its knee area a cutting element (not further shown), which serves for cutting a thread (not further shown), especially a needle thread, the cutting of the thread being performed by a further pivoting movement of the gripper hook 28. The further pivoting movement of the gripper hook 28 is to be understood so that during the usual pivoting movement of the gripper hook 28 the thread cannot come into contact with the cutting element, whereas in the course of a further pivoting movement the thread slides into the cutting element.

The invention claimed is:

1. Multiple needle sewing machine and in particular multiple needle chain stitch sewing machine, comprising stitch-forming elements having at least two needles and at least one gripper shaft with at least two gripper hooks arranged thereon, wherein a needle and a gripper hook respectively form a sewing element pair and wherein the needles and the gripper hooks are driven in a manner such as to perform chain stitches and in particular double chain stitches in a sewing material arranged on a sewing material support, using a needle thread and a gripper thread respectively, characterized in that the needles are connected indirectly or directly to a rotationally oscillating driving shaft and that at least one needle can be individually stopped and decoupled from the rotationally oscillating driving shaft in such a manner that in the stopped position decoupled from the rotationally oscillating driving shaft the needle(s) is(are) not moved in a translational fashion in the direction of the sewing material support during the sewing operation and thus does(do) not pierce the sewing material.

2. Multiple needle sewing machine according to claim 1, characterized in that the rotationally oscillating driving shaft with the needle can be connected to a seat through a driving lever, particularly designed as a cam, and a connecting rod that can be coupled to and decoupled from the seat.

3. Multiple needle sewing machine according to claim 1, characterized in that the needle(s) can be pneumatically or hydraulically coupled to and/or decoupled from the oscillating drive.

4. Multiple needle sewing machine according to claim 1, characterized in that each needle is arranged for replacement in a mounting support, the mounting support being arranged between the rotationally oscillating driving shaft and the needle.

5. Multiple needle sewing machine according to claim 4, characterized in that the mounting support is supported for translation on a machine frame.

6. Multiple needle sewing machine according to claim 1, characterized in that at least one of the gripper hooks can be decoupled from the gripper shaft.

7. Multiple needle sewing machine according to claim 1, characterized in that the gripper hooks and the associated needles can be decoupled.

8. A process for creating a sewing pattern in a multilayer sewing material, comprising:

connecting at least one needle thread and at least one gripper thread by means of a plurality of sewing bodies each including at least one needle and at least one gripper, and thereby forming a chain stitch; and subsequent to forming the chain stitch, transferring at least one needle individually from a position coupled to a rotationally oscillating driving shaft to a position decoupled from the rotationally oscillating driving shaft, so that the needle decoupled from the rotationally oscillating driving shaft does not participate at least in the next stitch.

9. The process according to claim 8, further comprising:

moving the sewing material in the sewing direction, thereby withdrawing the needle thread for the extension thereof from a thread supply; and subsequent to withdrawing the needle thread, knotting together the needle thread and the gripper thread and/or cutting off the needle thread.

10. Process according to claim 8, characterized in that the needle thread is knotted together with the gripper thread after a final stitch and particularly before the beginning of the next sewing pattern element.

11. Process according to claim 8, characterized in that the needle and/or gripper thread is or are cut after a final stitch and particularly before the beginning of the next sewing pattern element.

12. Process according to claim 8, characterized in that several needles arranged on at least one needle head are simultaneously coupled or decoupled.

13. Process according to claim 8, characterized in that the needle(s) is(are) hydraulically, pneumatically or electromechanically coupled or decoupled.

14. Process according to claim 8, characterized in that the needle(s) is(are) coupled or decoupled via a programmable control.

15. Process according to claim 14, characterized in that the programmable control takes place in line with one or more sewing patterns.

16. A multiple needle chain stitch sewing machine comprising:

a needle head;

a first needle and a second needle both coupled to the needle head;

a drive mechanism configured to translate the first needle together with the second needle, and to individually translate only one of the first needle or the second needle;

a gripper shaft; and a first gripper hook and a second gripper hook both coupled to the gripper shaft.

17. The sewing machine of claim 16, wherein the drive mechanism is configured to simultaneously couple with the first needle to translate the first needle and not couple with the second needle to not translate the second needle such that the second needle does not move toward and does not pierce sewing material during a sewing operation.

18. The sewing machine of claim 16, wherein the drive mechanism includes a first rotatable cam configured to translate the first needle, and a second rotatable cam configured to translate the second needle.

19. The sewing machine of claim 18, wherein the first rotatable cam is coupled to a first drive shaft and configured to selectively translate the first needle, and the second rotatable cam is coupled to a second drive shaft spaced apart from the first drive shaft and configured to selectively translate the second needle independent of whether the first needle is translated by the first rotatable cam.

* * * * *